US011046399B2

(12) United States Patent
Builder et al.

(10) Patent No.: US 11,046,399 B2
(45) Date of Patent: Jun. 29, 2021

(54) INFLATABLE WATER SPORTS BOARD RACK

(71) Applicants: Nautibuoy Marine Limited, Devon (GB); Clay Livingston Builder, Devon (GB); Nina Anderson, Devon (GB)

(72) Inventors: Clay Livingston Builder, Devon (GB); Nina Anderson, Devon (GB)

(73) Assignee: Nautibuoy Marine Limited, Devon (GB)

( * ) Notice: Subject to any disclaimer, the term of this patent is extended or adjusted under 35 U.S.C. 154(b) by 0 days.

(21) Appl. No.: 16/341,675

(22) PCT Filed: Oct. 13, 2017

(86) PCT No.: PCT/EP2017/076202
§ 371 (c)(1),
(2) Date: Apr. 12, 2019

(87) PCT Pub. No.: WO2018/069505
PCT Pub. Date: Apr. 19, 2018

(65) Prior Publication Data

US 2020/0039616 A1 Feb. 6, 2020

(30) Foreign Application Priority Data

Oct. 14, 2016 (GB) ..... 1617492
May 8, 2017 (GB) ..... 1707293

(51) Int. Cl.
*B63C 1/02* (2006.01)
*A47B 43/00* (2006.01)
(Continued)

(52) U.S. Cl.
CPC ..... *B63C 1/02* (2013.01); *A47B 43/00* (2013.01); *A47B 81/00* (2013.01); *B63B 7/08* (2013.01)

(58) Field of Classification Search
CPC ..... B63C 1/02; B63C 2009/042; B63B 7/00; B63B 7/08; B63B 7/085; B63B 32/51;
(Continued)

(56) References Cited

U.S. PATENT DOCUMENTS 2,875,771 A * 3/1959 Brewin ..... E04H 15/20 52/2.11
2,928,108 A * 3/1960 Cochrane ..... B63C 9/02 114/345
(Continued)

FOREIGN PATENT DOCUMENTS

DE 202013006522 U1 11/2014
EP 2684794 A1 1/2015
(Continued)

*Primary Examiner* — Jennifer E. Novosad
(74) *Attorney, Agent, or Firm* — Optimus Patents US, LLC

(57) ABSTRACT

An inflatable water sports board rack includes an inflatable tube comprising multiple paired inflatable uprights with gaps between the uprights configured to receive at least one water sports board there between; wherein the inflatable tube comprises an inflation valve for inflating the inflatable water sports board rack. A modular inflatable docking system as a kit of parts includes an inflatable water sports board rack as a pair of single inflatable retainers and at least one of: a floatable or inflatable platform to be coupled thereto.

17 Claims, 6 Drawing Sheets

(51) Int. Cl.
*A47B 81/00* (2006.01)
*B63B 7/08* (2020.01)

(58) Field of Classification Search
CPC ... B63B 34/22; B63B 2027/145; B63B 22/22; A47B 43/00; A47B 81/00
USPC ..... 211/85.7; 141/38; 114/345, 265, 266; 441/40, 41, 42, 30, 66; 52/2.18; D21/835, 801; 248/910
See application file for complete search history.

(56) References Cited

U.S. PATENT DOCUMENTS 3,268,925 A * 8/1966 Serra ..... B63C 9/02 441/40
3,425,071 A * 2/1969 Frieder ..... B63B 7/08 441/40
3,513,494 A * 5/1970 Tailer ..... B63B 7/082 114/345
3,899,797 A * 8/1975 Gunst ..... A47C 4/54 5/655.3
3,931,655 A * 1/1976 Luscombe ..... B63B 7/082 114/352
3,994,102 A * 11/1976 Johnson ..... E04H 15/20 52/2.21
4,064,801 A * 12/1977 Switall ..... B41F 7/30 101/147
4,179,832 A * 12/1979 Lemelson ..... F21S 2/00 40/540
4,197,681 A * 4/1980 Holcombe ..... E04C 3/005 52/2.21
4,202,452 A * 5/1980 McCormick ..... B65D 85/48 206/448
4,280,429 A * 7/1981 Wells ..... B63C 1/06 114/125
4,556,391 A * 12/1985 Tardivel ..... A63H 33/00 135/125
4,998,900 A * 3/1991 Wright ..... B63C 9/04 114/349
5,056,453 A * 10/1991 Wright ..... B63C 7/003 114/345
5,141,116 A 8/1992 Mojica
D388,494 S * 12/1997 Liu ..... D21/839
D389,219 S * 1/1998 Liu ..... D21/835
5,761,852 A * 6/1998 Liu ..... E04H 15/20 446/220
5,895,085 A * 4/1999 Miller, Jr. ..... A47F 7/06 211/85.7
D410,259 S * 5/1999 Sumner ..... D21/440
5,901,890 A * 5/1999 Stokes ..... A01K 97/10 114/343
5,906,304 A 5/1999 Baldacchino
D410,713 S * 6/1999 Sherwood ..... D21/699
5,927,228 A * 7/1999 Richard ..... B63B 43/14 114/345
5,947,354 A * 9/1999 Williams ..... B60R 9/04 224/318
5,967,869 A * 10/1999 Wiggins ..... B63C 9/04 441/38
5,987,822 A * 11/1999 McNiff ..... E04H 15/20 135/125
D422,667 S * 4/2000 Lau ..... D21/814
6,209,474 B1 * 4/2001 Foss ..... E02B 17/00 206/403
6,457,619 B1 * 10/2002 Werner ..... B60P 3/40 224/405
6,582,265 B1 * 6/2003 Graham ..... A63H 23/02 114/345
6,656,301 B2 * 12/2003 Kirby ..... B29D 30/0016 156/110.1
6,685,520 B1 * 2/2004 Wiggins ..... B63B 43/12 441/40
D504,488 S * 4/2005 Peterson ..... D21/803
6,923,133 B1 * 8/2005 Ross ..... B63C 3/06 114/45
6,945,836 B1 * 9/2005 Lorier ..... B63B 1/14 441/66
D511,363 S * 11/2005 Nicholson ..... D21/818
D515,167 S * 2/2006 Capwell ..... D21/803
D525,009 S * 7/2006 McKenney ..... D99/17
D526,689 S * 8/2006 Marshall ..... D21/473
7,083,055 B1 * 8/2006 Ambrosat ..... A63B 71/0045 211/85.7
7,181,877 B2 * 2/2007 Quade ..... E04H 15/20 40/610
D592,270 S * 5/2009 Cobb ..... D21/835
7,611,148 B2 * 11/2009 Caswell ..... A63B 63/004 273/400
7,686,247 B1 * 3/2010 Monson ..... B64F 1/02 244/110 R
D648,168 S * 11/2011 Goeckel ..... D6/601
D652,884 S * 1/2012 VanElverdinghe ..... D21/801
8,376,082 B2 * 2/2013 Grainger ..... B63B 27/143 182/48
8,413,600 B2 * 4/2013 Kaye ..... B63B 7/082 114/345
8,800,467 B2 * 8/2014 Temple ..... A01K 97/10 114/345
D741,975 S * 10/2015 Rademacher ..... D21/801
9,150,292 B2 * 10/2015 Ibsen ..... B63B 35/58
10,086,919 B2 * 10/2018 Barnes ..... B63C 1/02
D870,834 S * 12/2019 Hsu ..... D21/814
10,494,067 B1 * 12/2019 Womack ..... B63B 34/00
2002/0166494 A1 * 11/2002 Inglis ..... B63C 9/06 114/345
2003/0220032 A1 * 11/2003 Hsu ..... B63B 34/50 441/131
2004/0154523 A1 * 8/2004 Arias ..... B63B 7/08 114/343
2005/0166434 A1 * 8/2005 Barlow ..... G09F 21/18 40/610
2005/0284031 A1 * 12/2005 Chen ..... A63G 31/12 52/2.11
2006/0033283 A1 * 2/2006 Cheng ..... A63B 43/005 273/407
2006/0073748 A1 * 4/2006 Boujon ..... E04H 4/065 441/40
2006/0108302 A1 * 5/2006 Matsui ..... A47B 81/005 211/85.7
2006/0218825 A1 * 10/2006 Steams ..... D06F 57/00 38/102
2007/0000182 A1 * 1/2007 Boujon ..... A63B 5/11 52/2.17
2007/0108145 A1 * 5/2007 Milardo ..... A47B 73/00 211/74
2008/0083683 A1 * 4/2008 Apps ..... A47B 73/006 211/74
2008/0186802 A1 * 8/2008 Bungay ..... B01F 11/0065 366/142
2008/0188332 A1 * 8/2008 Caswell ..... A63B 63/004 473/478
2009/0283436 A1 * 11/2009 Carcamo ..... B63B 32/80 206/522
2010/0301081 A1 * 12/2010 DeGroot ..... B60P 3/1008 224/405
2014/0171232 A1 * 6/2014 Carney ..... A63B 63/00 473/477
2015/0034578 A1 * 2/2015 Wilhelm ..... A47F 7/0028 211/85.7
2015/0151817 A1 * 6/2015 Rasmussen ..... B63C 9/04 441/38
2015/0306488 A1 * 10/2015 Gouldthorpe ..... A63C 17/017 312/330.1
2016/0114734 A1 * 4/2016 Ferre-Rangel ..... B60R 9/08 211/85.7
2016/0167748 A1 * 6/2016 Dias ..... B63B 32/80 211/85.7
2017/0314818 A1 * 11/2017 Stoeger ..... F24S 25/10
2018/0028023 A1 * 2/2018 Allen ..... A47K 3/024

(56) References Cited

U.S. PATENT DOCUMENTS

| | | | | |
|---|---|---|---|---|
| 2019/0135390 | A1* | 5/2019 | Barnes | B63C 1/06 |
| 2019/0203533 | A1* | 7/2019 | Thomas | E06C 7/08 |
| 2019/0308698 | A1* | 10/2019 | Builder | B63B 7/08 |
| 2020/0039616 | A1* | 2/2020 | Builder | A47B 43/00 |
| 2020/0047969 | A1* | 2/2020 | Liao | B65D 81/03 |

FOREIGN PATENT DOCUMENTS

| | | | |
|---|---|---|---|
| FR | 127913 | A | 12/1956 |
| FR | 2853189 | A1 | 6/2011 |
| GB | 920588 | A1 | 3/1963 |
| WO | 9834813 | A1 | 8/1998 |
| WO | 03066409 | A1 | 8/2003 |
| WO | 2007028204 | A1 | 3/2007 |
| WO | 2018141471 | A1 | 8/2018 |

* cited by examiner

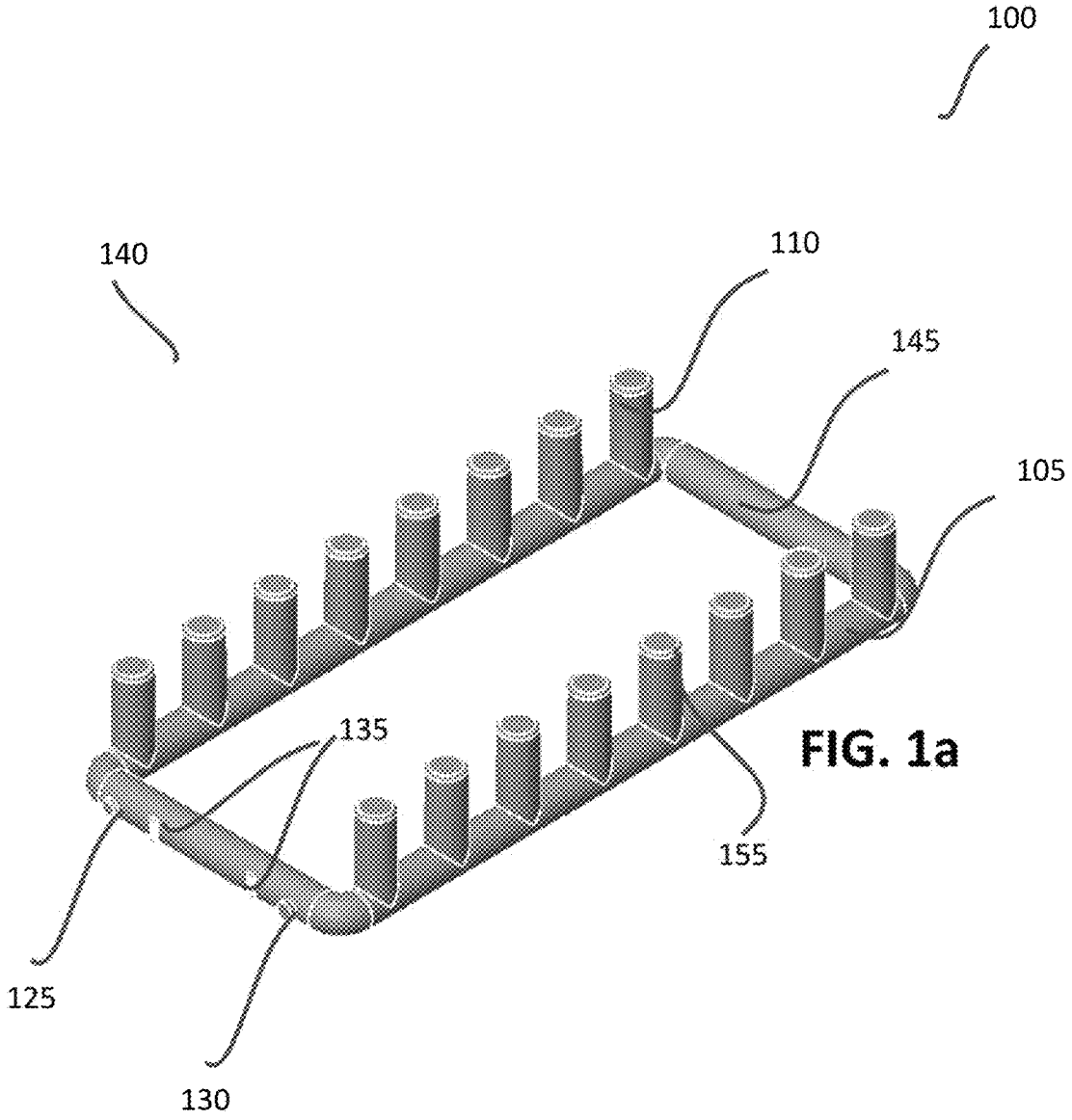
FIG. 1a
FIG. 1b
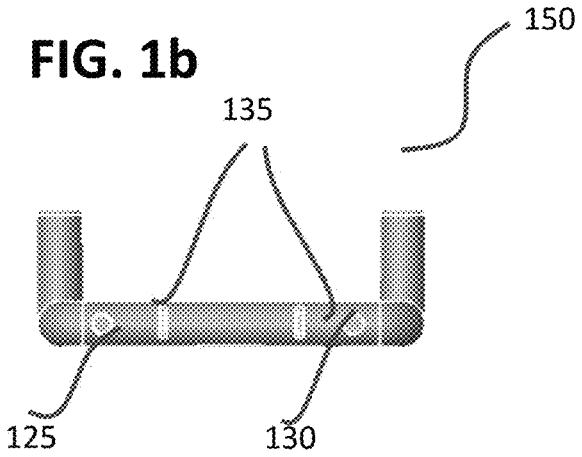
FIG. 1c
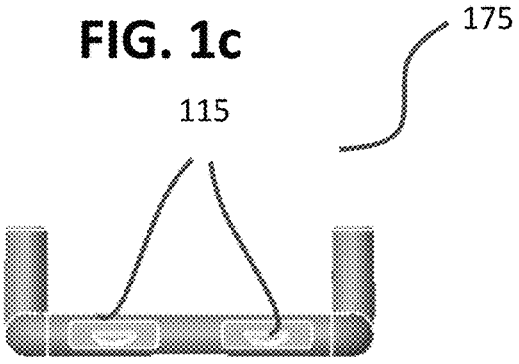

INFLATABLE WATER SPORTS BOARD RACK

FIELD OF THE INVENTION

The field of this invention relates to a water sports board rack. In particular, the field relates to an inflatable water sports board rack for use on water, to facilitate ease of storage and ease of setting up.

BACKGROUND OF THE INVENTION

Many water sports exist, with a large number of water sports using water boards. Beach or lake or river water sports shacks, such as water sport board hiring stations, are opening up close to large bodies of water and typically support a variety of water sports. Each of the current water board sports typically use different sized and shaped boards. For example, current board sizes vary in size as follows: surf boards are typically 1.8 m to 2.4 m on average; kite boards are typically 1.3 m to 1.6 m on average; and wake boards are typically 1.3 m to 1.4 m on average.

A water sport that is becoming increasingly popular is stand up paddle boarding, with stand up paddle boards being much longer than other known water sport boards at an average of 2.8 m to 3.6 m. Some larger yachts are known to have up to six stand-up paddle boards, attached to a back of the yacht by a 'dockline', when in use. This is not an ideal tethering arrangement, as the stand-up paddle boards can move with the current and collide into one another. They also get in the way when the tender is in use and other 'sports toys' are in use at the stern of the yacht (or other similar vessel). This leads to safety concerns. Additionally, problems and safety concerns arise with dock lines floating in the water and potentially getting tangled around propellers or sucked into jet drives such as Tenders, Seabobs™ and Jet-skis.

Storage of multiple boards, either in water sport shacks or hiring stations, or inside yachts is problematic. Multiple boards for a particular water sport are typically stored in fixed racks, with different fixed racks used for the respective different water sports. These fixed racks are currently made out of inflexible materials, such as metal or wood. Such fixed racks are also known to be attached to the outside of boats or yachts at a high level, e.g. for transportation purposes. Fixed storage options on the outside of vessels such as yachts also means that they are for transportation and held in place and not easily accessible for use As such racks are fixed and made out of inflexible materials, they are also not readily transportable to where the users are actually using the boards.

The inventor of the present invention has recognised and appreciated a need for an improved securing of water sport boards, particularly for a variety of sized boards and across multiple water sports. Furthermore, the inventor of the present invention has recognised and appreciated a need for better organising multiple boards, such as stand-up paddle boards, when not in use, whilst ensuring that they are easily accessible for intermittent use throughout the day. The inventor of the present invention has also recognised that it would be beneficial for such a water sports board rack to be placed close to the user, for example, at water level.

SUMMARY OF THE INVENTION

Accordingly, the invention seeks to mitigate, alleviate or eliminate one or more of the above mentioned disadvantages, either singly or in any combination. Aspects of the invention provide for an inflatable water sports board rack, for example to secure a variety of water boards.

These and other aspects of the invention will be apparent from, and elucidated with reference to, the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the FIGS. are illustrated for simplicity and clarity and have not necessarily been drawn to scale.

FIG. 1*a*, FIG. 1*b* and FIG. 1*c* illustrate various views of an inflatable solo board rack without water sports boards according to example embodiments of the present invention.

DETAILED DESCRIPTION

Figure 2A:
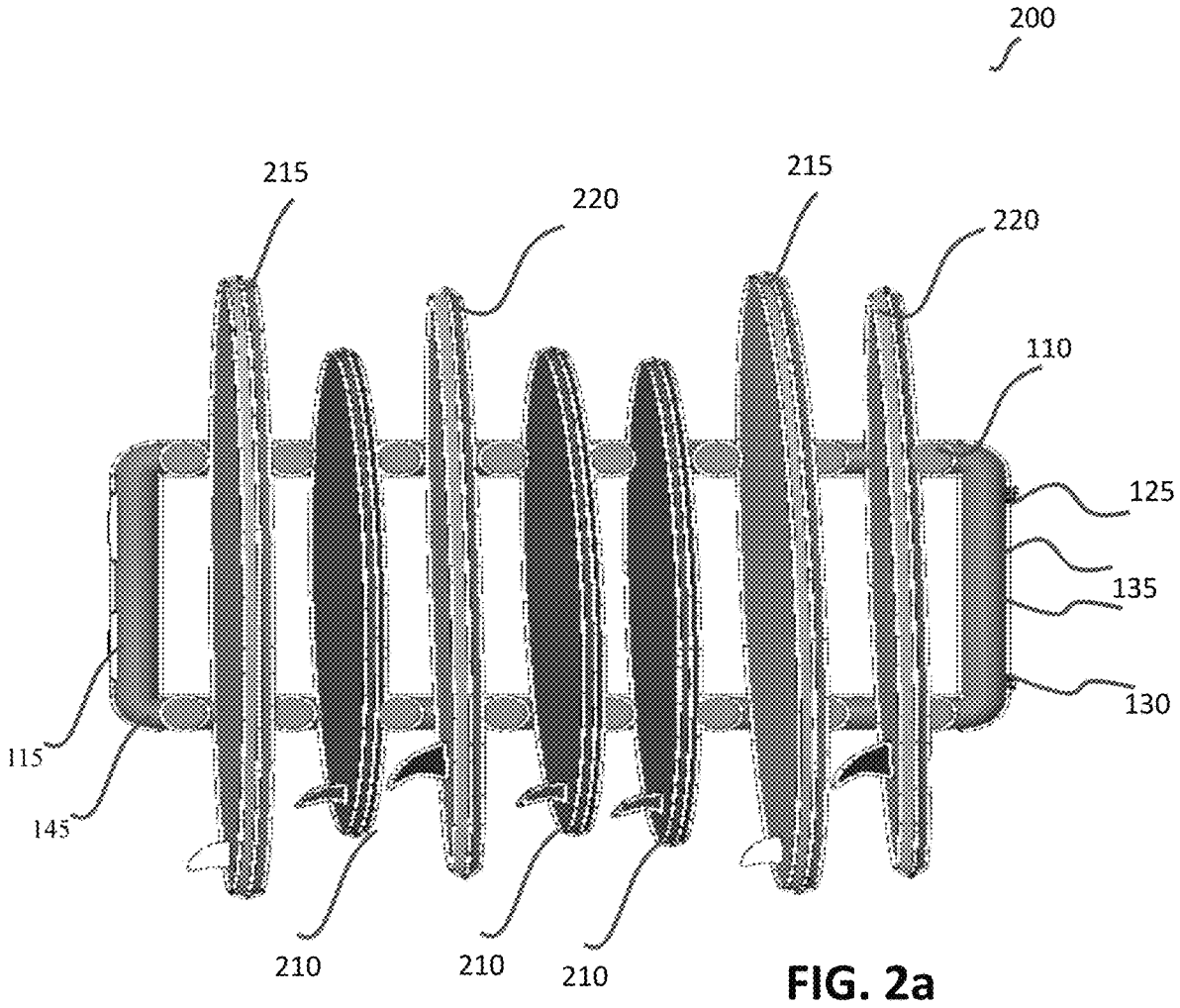
FIG. 2*a* and FIG. 2*b* illustrate various views of an inflatable solo board rack with water sports boards according to example embodiments of the present invention.

As the illustrated examples of the present invention may for the most part, be implemented using electronic components and circuits known to those skilled in the art, details will not be explained in any greater extent than that considered necessary as illustrated below, for the understanding and appreciation of the underlying concepts of the present invention and in order not to confuse or distract from the teachings of the present invention.

Although examples of the invention are described with reference to various sizes and shapes of inflatable platforms and inflatable solo board racks it is envisaged that other sizes and shapes of inflatable platforms suitable for storing water sport boards may benefit from the concepts described herein. Examples of the invention provide for both individual inflatable solo board rack structure, for example with a ballast and modular inflatable tubes. Other examples of the invention provide for inflatable tubes that can be coupled to one or two or more floatable and/or inflatable platforms.

Advantageously, examples of the invention provide an improved inflatable rack for various water sports boards. Examples of the invention provide easy access, and indeed water-based access, to the various water sports boards for use in the water. This is particularly advantageous for stand-up paddleboards (SUPs), which are large in size and are a relatively new water sports board to the market of which lots are being sold.

The inflatable platforms and inflatable solo board racks can be made in various sizes and dimensions to accommodate a variety of surf board, stand-up paddle boards, windsurfing boards, kite surfing boards, wake boards, etc. It is designed so the boards can be easily accessible at water level, whilst also being secure and due to the inflatable nature protected from any damage. The Rack is also designed to be inflatable for boats that are limited on storage and portable for water sports centres.

The inflatable concept enables the rack to be easily deflated and stowed during, say, a yachts sailing. It also means that the rack can be inflated and bought to water-level where the users actually are and store one or more water sport boards at water level during use, rather than the boards having to go back on to the boat or be fixedly attached to a line as currently done. In this manner, users will be able to use a paddle board or a wake board for a while, and then easily return the board to a secure location and try a different board, without getting out of the water or potentially damaging any of the water sport boards (or the main vessel). The Inflatable nature of the rack also means that it will not cause any damage to the boards, which happens when constantly taking out of the water.

In some examples, the inflatable rack stores one or multiple water boards on their sides on the water, when not in use, where the user is actually using the product.

The inflatable solo board racks may be designed in various forms to either be used in conjunction with the NautiBuoy™ Platforms (Air Toggle board rack). Alternatively the inflatable solo board racks may be secured to the back of any water-bound vessel without the need for one of NautiBuoy™ platforms. The inflatable solo board racks can also be secured to any other structure, for example fixed pontoon/rigid floating platform used for water sports stations etc., or it can also be anchored on its own. The solo board rack does also have the option to connect to one of the NautiBuoy™ platforms using the Air Toggle system.

Referring now to FIG. 1*a*, FIG. 1*b* and FIG. 1C, various views of an inflatable solo board rack 100 without water sports boards is illustrated, according to a first example embodiment of the present invention. A first pictorial view 140 illustrates the general construction of the inflatable solo board rack 100. A second view 150 illustrates the substantially U-shaped design from the front, with a third view 175 illustrating the substantially U-shaped design from the rear.

In this example of a first pictorial view 140, an inflatable tube 145, in a range of say 20 cm or 25 cm in diameter, and for example configurable in a substantially rectangular-shaped (top view) design, is used as an inflatable storing rack for water sports boards, as per the drawings. Thus, in this manner and advantageously, the inflatable water sports board racks 100 may be set, transported and stored easily. In some examples, it is envisaged that the base tube of the inflatable tube 145 may vary in length and diameter to fit different size platforms and rack designs. In other examples, different lengths for different racks may be provided. Furthermore, in other examples, it is envisaged that separate air chambers may be supported in a base tube of the inflatable tube 145, for example in case of tube failure through puncture.

To support the water sports boards, multiple paired inflatable uprights 110 are provided, with gaps 105 located between the paired inflatable uprights 110 are provided to receive the water sports boards. One example of the approximate dimensions of the paired inflatable uprights is: height of 50 cm, diameter of 20 cm and gap distance of 25 cm, although these dimensions may vary with other designs and in order to support different board types. In tests, it has been found that a gap of 18 cm and an upright height of 43 cm are preferred, in order to fit all boards in. Therefore, it is envisaged that a margin of +20% of these preferred dimensions would still provide a satisfactory, albeit non-optimum, solution. In some examples, an additional protective layer may be included on the inflatable tube 145 base in the gaps and/or either side of the gaps 105 on the paired inflatable uprights 110, which may ease a sliding in of the boards and also to reduce wear and tear. In some examples, the uprights may be protected either side all the way to the top of the upright, with an extra layer of PVC to protect where the fins of the boards can rest against the inflatable uprights as well as reduce fin damage of the board, e.g. using PVC™ layer with a Diamond finish as per Nautibuoy™ Platform. In some examples, a material to enable that, such as an extra layer of PVC for extra protection and reduce wear, or a plastic modelled fitting may be used in between each upright (in this regard.)

In some examples, the multiple paired inflatable uprights 110 are provided with a board retainer ring 155, for example on every upright. In this manner, the board retainer ring 155 may be used to secure, say, the paddles and the boards onto the inflatable solo board rack 100 to prevent loss of the paddles or boards in large swells. In some examples, the board retainer ring 155 may include D-rings or strong points or a similar fixing mechanism or the like. The board retainer rings 155 are shown in the locations in FIG. 1 for explanatory purposes only, and in other examples could be located at other positions on the inflatable solo board rack 100 or on the paired inflatable uprights 110, or may change in design shape so long as they are able to perform the function of securing the paddles and/or the boards. Most boards have some sort of D-ring or loops formed on them that a carabiner type hook could be attached. In some examples, it is envisaged that a double D-ring may be employed at the top of each inflatable upright. In this example, a double D-ring located at the top allows the D-Rings to be pulled in the correct, desired direction, whereas with just one D-ring there may be a conflict for it to be pulled both ways. In some examples, it is envisaged that a stretchable bungee line may be attached to one of the D-rings, with a carabiner-type hook located on the end. In this example, the bungee may then be stretched over the top of the board to push it down into the board rack to hold it in place. Here, the carabiner type hook on the end of the bungee is then attached to one of the D-Rings on the opposite upright. In some examples, the carabiner-type hook may be attached to the loop that forms on the surf board, where the surf board leash attaches, which acts as a secondary connection to prevent loss of the board in large swells. In some examples, the height of the upright may be configured to be lower than the height of the, or each, board so that the bungee line traverses up and over the board to apply pressure downwards.

In some examples, air toggle loops 135 may be positioned at various locations around the inflatable solo board rack 100. For example, in the illustration in FIG. 1, two air toggle loops 135 are positioned at the very front of the inflatable solo board rack 100. Two air toggle loops 135 are positioned to provide increased flexibility of linking multiple inflatable solo board rack 100 and/or with platforms, e.g. inflatable platforms, as described in the example embodiments of FIGS. 4 to 6. In some examples, air toggle loops 135 may be located along the long sides too, so that they can be used to link to a platform.

One such air toggle system is described in Applicant's co-pending application (GB2531066), the contents of which are incorporated herewith in full. This co-pending application describes an arrangement whereby an air toggle system can be manufactured and sold on its own, thereby allowing it to be retro-fit by, say, glue, to existing inflatable structures, and thus may be purchased individually to attach each inflatable solo board rack 100 purchased.

In some examples, air toggle loops 135 may be configured of a loop of fabric (for example, say, 25 mm wide and approximately 57 cm long). When not in use they may be held in place with a Velcro™ flap, for example about 8 cm in length. It is envisaged that in other designs, different securing mechanisms may be employed for the air toggle loops of the inflatable solo board rack 100 (or variations thereof).

In some examples, air toggle loops 135 are configured such that, in use, the Velcro flap is released. When linking an inflatable solo board rack to an inflatable platform, for example, the air toggle loops 135 are released on the sides of the inflatable solo board rack and sides of the inflatable platform to be joined. Thereafter, the connection is achieved by inserting a separate deflated, say, 20 cm diameter buffering tube (although the size may vary), through all of the released air toggle loops 135, then inflating the separate buffering tube for an entrapment free connection. As a comparable example, consider how a pin is used to secure a metal pipe in a door hinge.

It is envisaged that in other designs, more or fewer air toggle loops 135 may be positioned at locations around the inflatable solo board rack 100. Furthermore, it is envisaged that in other designs, the air toggle loops 135 may be positioned at different locations around the inflatable solo board rack 100, dependent on the prevalent design considerations.

Each inflatable solo board rack 100 includes an inflation valve 125. Furthermore, each inflatable solo board rack 100 includes a pressure release valve 130. In some examples, the pressure release valve 130 may provide increased safety, such that as pressure increases in high temperatures, the pressure release valve may regulate the pressure to ensure that the tubes 145, 155 don't explode in high heats or put undue pressure on the seams. The inflation valve 125 and pressure release valve 130 are shown in the locations in FIG. 1 for explanatory purposes only, and in other examples could be located at other positions on the inflatable solo board rack 100, for example on the inside of the tubes. If the option of a second or further air chambers is/are adopted for protection of full deflation of solo inflatable board rack 100 due to puncture or such like, each chamber will require its own inflation valve 125 and pressure release valve 130.

In some examples, the shape and size and configuration of the inflatable solo board rack 100 may vary, and as such some inflatable solo board racks 100 may be configured to accept, say, 3 or 4 boards, whereas other inflatable solo board racks 100 may be configured to accept more. In some examples, the inflatable solo board rack 100 may be configured to support only a particular board type, for example, a solo board rack 100 that can store pairs of SUPs or pairs of surf boards, etc. In some examples, it is envisaged that multiple solo board rack 100 configured to support only a particular board type may also be linked together with an air toggle connection.

In some examples, an anchor point (not shown) may be positioned to an underside of the inflatable tube 145 so that the inflatable solo board rack 100 can be fully anchored, to secure safe storage. Advantageously, the anchoring option for the inflatable solo board rack 100 enables it to be flexible on its location, in that the user doesn't necessarily require a yacht or structure to secure it to. In some examples, further anchor points may be added around the inflatable structure. In some examples, the anchor points may be located at a different location, e.g. at the same end as the inflation valves or along the long sides.

In examples of the invention, through provision of an inflatable solo board rack 100 the storage of sports water boards may be performed on the water, i.e. closer to where the water boards will be used. Also, through provision of an inflatable solo board rack 100 the rack can be readily deflated, transported and stored in a much more condensed manner than current wooden or metallic racks, when not in use.

The second view 150 illustrates the substantially U-shaped design from the front, with the air toggle loops 135, inflation valve 125 and pressure release valve 130. The third view 175 illustrates the substantially U-shaped design from the rear with a fixing mechanism 115, such as D-rings or strong points to secure the rack to the vessel or other structure. Thus, in some examples, a means of connecting the inflatable solo board rack 100 to a vessel, a pontoon, or the like, etc. is provided, so that the inflatable solo board rack 100 can be secured to an object in water, either at sea or in lakes, etc. In some examples, it is envisaged that the strong points may vary on where they will be located and how many of them are used, for example in some examples they are positioned along the long sides too, or in some examples on the tops of the tubes on the short or long ends.

In some examples, the inflatable solo board rack 100 may include a ballast bag (not shown) with a manual dump system. One such ballast bag with manual dump system, may be employable at, say corners of the inflatable solo board rack 100 or at other points say, mid points along the tubes of 145. In some examples, it is envisaged that the ballast bag with manual dump system, may be employable on, say the short end mid-points, or at the ends of the long tubes or any other part of the underside of the tubes. In some examples, it is envisaged that the ballast bag may be located on the undersides of the long sides of the inflatable tube, the ones with the uprights only, for example when an anchor point is located on one of the short sides. In some examples, for say, a solo board rack with four boards, four ballast bags may be incorporated, one on each end of the long sides of the tube, with in some examples anchor points located on the long sides in between ballast bags.

Advantageously, in some example embodiments, the ballast bag may be configured to hold a substantial amount of water, e.g. 40 litres, and configured to fill automatically when located in a vertically down position. In some examples, the size of the ballast bag may be less than this and may be dependent upon the size of the inflatable structure and the number of board racks to be stored. In this manner, a ballast bag is configured, when full of water, to keep the inflatable solo board rack 100 relatively stable in the water when the water sports boards are being inserted into, or removed from, inflatable solo board rack 100 and stop the docking station swinging around in the breeze when either in use, or not. Furthermore, the ballast bag prevents the inflatable solo board rack 100 from flipping/blowing over in winds too. In some examples, it is envisaged that the weight of the ballast, as well as the number, and position, of ballast bags used may be dependent upon the size of inflatable solo board rack 100.

In some examples, such a ballast bag may be locatable in (a vertical down-fill) position via a ballast bag strap, such that it may be kept in place in the vertical down-fill position with a suitable material, e.g. Velcro™ or glued with a pull-up strap to dump the ballasted water. In some examples, a dump system is provided to facilitate water being removed in one movement from the ballast bag with manual dump system. In some examples, the dump system may be configured by releasing the ballast bag strap from the Velcro™ tether, pulled up and then re-applied with a lower piece of Velcro on both the strap and the inflatable solo board rack 100, in order to hold the dump in the up position before removing the inflatable solo board rack 100 easily from the water. In some examples, a ballast bag without a dumping arrangement may be used. In this example, the ballast bag without the manual dump system may be approx. 80-90 cm cm long×13 cm wide×25 cm deep in the water. The ballast bags fill automatically with holes that allow them to fill and have small drainage holes at the bottom. As they do not hold 40 litres of water each they do not require a dump mechanism. In some examples, it is also envisaged that weights (instead of ballast) may be added in each corner to the base of the structure of the inflatable solo board rack 100 as a means of holding it down in the wind.

Figure 2B:
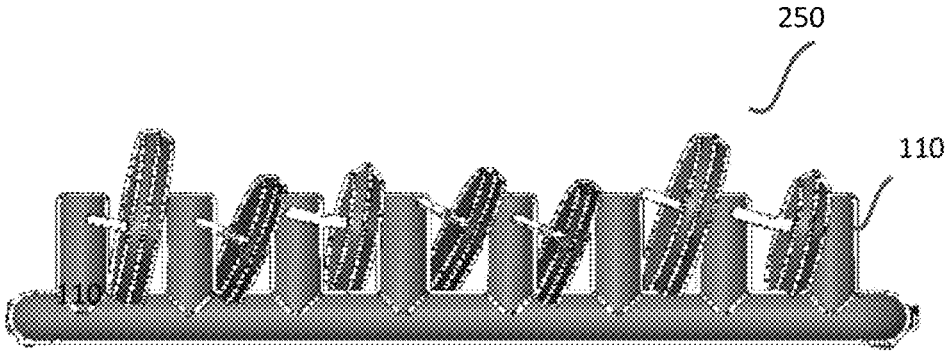

Referring now to FIG. 2*a* and FIG. 2*b*, various views of an inflatable solo board rack with water sports boards according to example embodiments of the present invention. A first view 200 illustrates a top plan view of an inflatable solo board rack 100 with water sports boards stored therein. A second view 250 illustrates a side plan view of the inflatable solo board rack 100 with water sports boards stored therein.

Again, in this example, the inflatable solo board rack 100 is formed from an inflatable tube 145 and includes air toggle loops 135 an inflation valve 125 and a pressure release valve 130. The first view 200 illustrates a top plan view of an inflatable solo board rack 100 with water sports boards stored therein, for example, larger stand-up boards 215, surf boards 220; and kite boards or wake boards 210. The second view 250 illustrates a side plan view of the inflatable solo board rack 100 with water sports boards stored therein and separated by multiple versions of the paired inflatable uprights 110.

One such air toggle linking system is described in Applicant's co-pending application (Application number GB 1417973.3), the contents of which is incorporated herewith in full. This co-pending application describes an arrangement whereby the coupling link buffering tube can be manufactured and sold separately to insert as the pin, thereby allowing the air toggle loops to be retro-fit by, say, glue, to existing inflatable structures, and thus the coupling link buffering tube may be purchased individually to link each inflatable solo board rack 100 purchased.

In particular, and advantageously, the inflatable tube 145 may be designed and shaped so that it fits various sizes of water sports boards, with respect to width of the rack, height of the uprights or the gap between the retainers. For example, each of the current water board sports typically use different sized and shaped boards. For example, current board sizes vary in size as follows: Stand Up Paddle Boards are typically 2.8 m to 3.6 m on average; surf boards are typically 1.8 m to 2.4 m on average; kite boards are typically 1.3 m to 1.6 m on average; and wake boards are typically 1.3 m to 1.4 m on average.

Figure 3A:
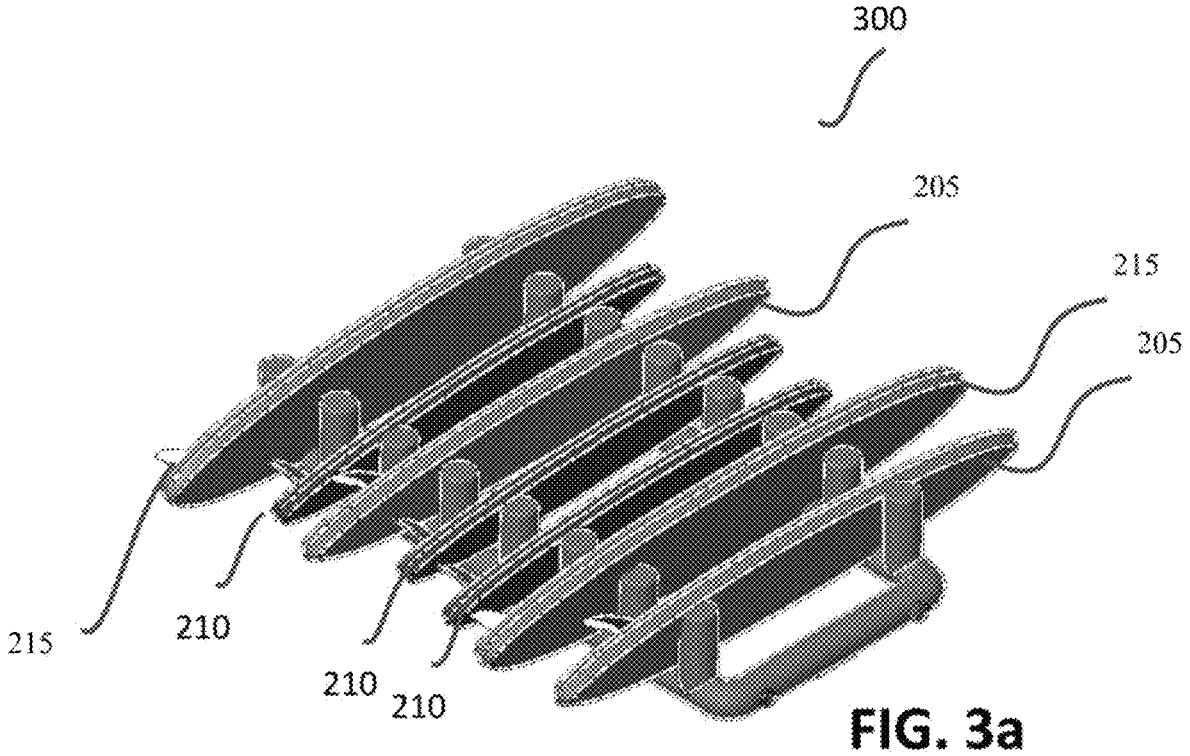
FIG. 3*a* and FIG. 3*b* illustrate various views of an inflatable solo board rack with water sports boards, according to example embodiments of the present invention.
Figure 3B:
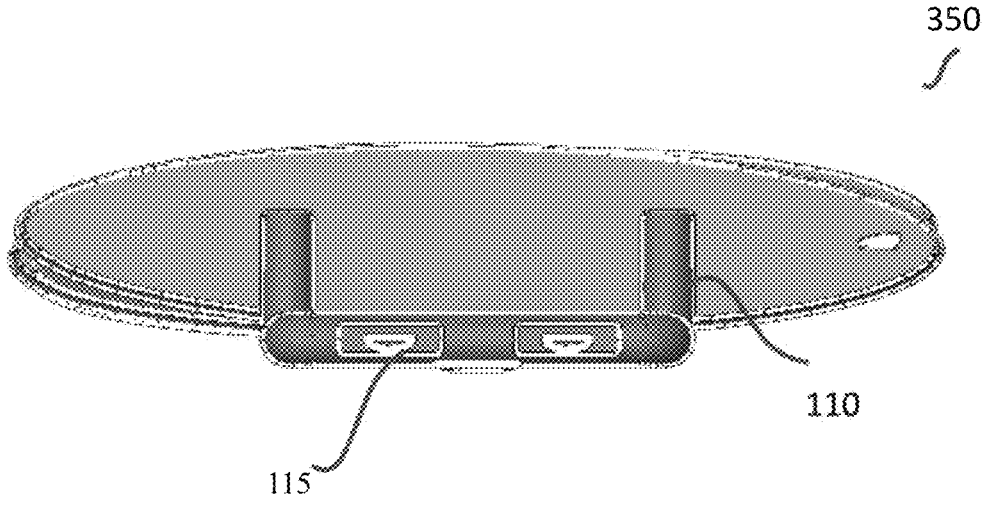
Figure 4A:
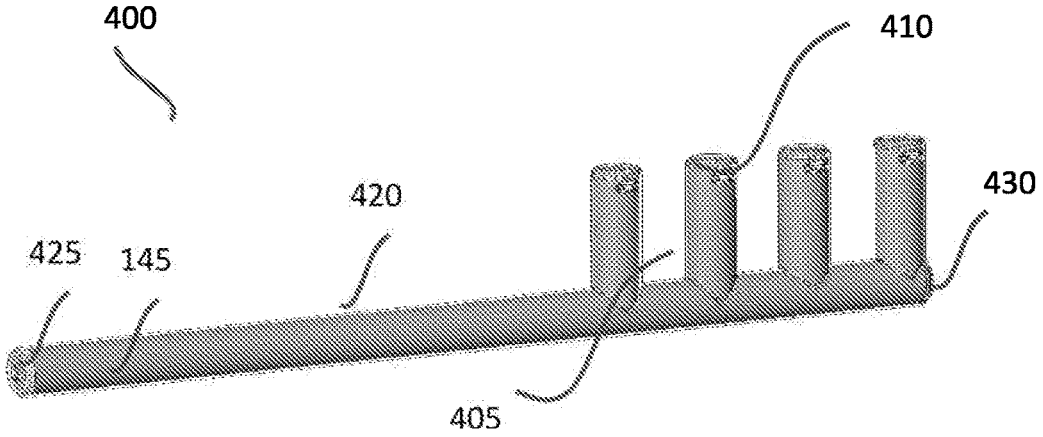
FIG. 4*a*, FIG. 4*b*, FIG. 4*c* and FIG. 4*d* illustrate examples of a retainer, together with various views of a first example of two retainers being used with floatable and/or inflatable platform, according to a second example embodiment of the present invention.
Figure 4B:
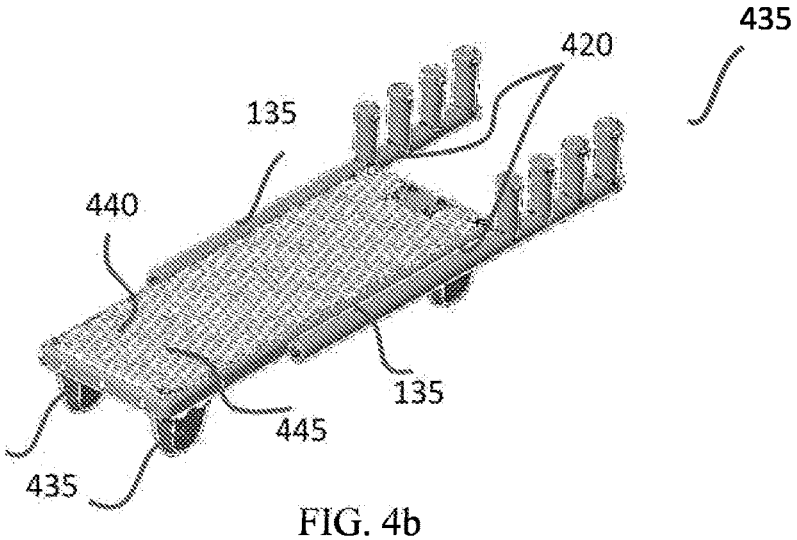
Figure 4C:
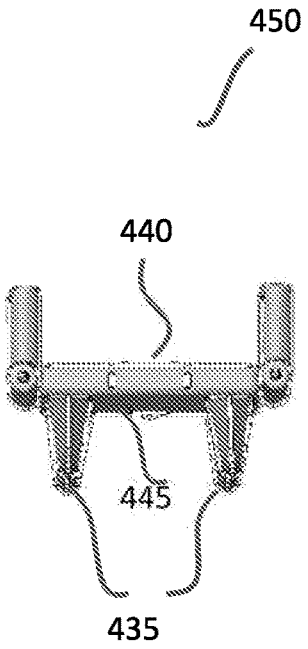
Figure 4D:
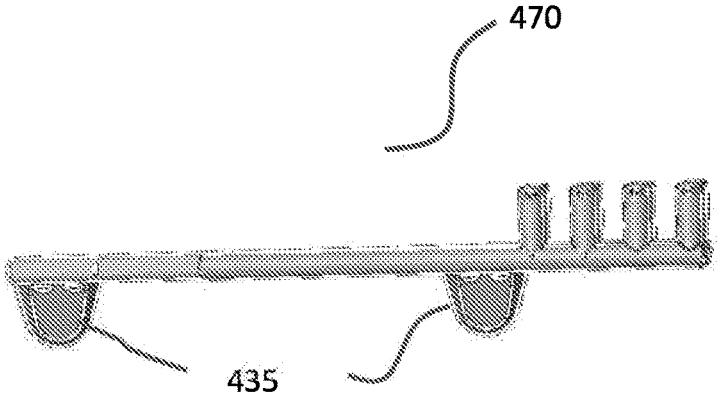

FIG. 3*a* and FIG. 3*b* illustrate further various views of an inflatable solo board rack 100 with water sports boards, according to example embodiments of the present invention. A first view 300 illustrates a pictorial view of an inflatable solo board rack 100 with water sports boards stored therein. Again the first view 300 illustrates, for example, larger stand-up boards 215, surf boards 205; and kite boards or wake boards 210 being stored in the inflatable solo board rack 100. The second view 350 illustrates a rear view of the inflatable solo board rack 100 with water sports boards stored therein and separated by multiple versions of the paired inflatable uprights 110.

FIG. 4*a*, FIG. 4*b*, FIG. 4*c* and FIG. 4*d* illustrate an example of a retainer, which may be considered as an example of an air toggle board rack tube, together with various views of a first example of two inflatable retainers or air toggle board rack tubes being used with floatable and/or inflatable platform, according to a second example embodiment of the present invention.

A first view 400 illustrates a single inflatable retainer or air toggle board rack tube 420. The single inflatable retainer or air toggle board rack tube 420 includes inflatable uprights 410 are provided, with gaps 405 located between the inflatable uprights 410. Thus, when two single inflatable retainers or air toggle board rack tubes 420 are coupled together, they are able to receive the water sports boards. The single inflatable retainer or air toggle board rack tube 420 includes an inflatable tube 145, of say 15-25 cm, and preferably 20 cm, in diameter.

In some examples, the air toggle loop linking system works by releasing the air on one or both inflatable retainer or air toggle board rack tube(s) 420 along with the air toggle loops on the platforms or, for example, other objects such as inflatable solo board rack(s) 100 and thereafter inserting the deflated 20 cm retainer or air toggle board rack tube(s) 420 through all of the released air toggle loops 135, then inflating the retainer or air toggle board rack tube(s) 420 for an entrapment free connection. As a comparable example, consider how a pin is used to secure a metal pipe in a door hinge. In some examples, the retainer or air toggle board rack tube may be coupled to the platform with an air toggle connection pin or buffering tube. In this example (not shown) the air toggle loops may be located along the inside of tube 420.

In some examples, an inflation valve 425 and a pressure release valve 430 may be employed, as shown. In some examples, it is envisaged that multiple chambers may be included in the inflatable structure, whereby each chamber may be provided with an inflation valve and pressure release valve. In some examples, further retainers may be included, for example located on the top of each upright 410 and configured, say, to hold the boards and paddles in on each of retainer or air toggle board rack tube(s) 420. In other examples, it is envisaged that the board retainer ring may be located at other positions on the inflatable solo board rack or on the paired inflatable uprights, or may change in design shape so long as they are able to perform the function of securing the paddles and/or the boards. Again, in some examples, it is envisaged that a double D-ring may be employed at the top of each inflatable upright. In this example, a double D-ring located at the top allows the D-Rings to be pulled in the correct, desired direction, whereas with just one D-ring there may be a conflict for it to be pulled both ways. In some examples, it is envisaged that a stretchable bungee line may be attached to one of the D-rings, with a carabiner-type hook located on the end. In this example, the bungee may then be stretched over the top of the board to push it down into the board rack to hold it in place. Here, the carabiner that is attached to the D-Ring without the bungee may be attached on the opposite upright. In some examples, the height of the upright may be configured to be lower than the height of the, or each, board so that the bungee line traverses up and over the board to apply pressure downwards.

A second pictorial view 435 illustrates a pair of single inflatable retainers or air toggle board rack tube(s) 420 that are attached to floatable and/or inflatable platform 440. A third end view 450 illustrates the pair of single inflatable retainers or air toggle board rack tube(s) 420 that are attached to floatable and/or inflatable platform 440. A fourth side view 470 illustrates the pair of single inflatable retainers or air toggle board rack tube(s) 420 that are attached to floatable and/or inflatable platform 440. By coupling the pair of single inflatable retainers or air toggle board rack tube(s) 420 in this manner, the structure is able to receive water sports boards located in the gaps 405 between the paired inflatable uprights 410 as shown. In one example, the width of the floatable and/or inflatable platform 440 is 1.5 m, resulting in a total width of the frame being 1.9 m.

In these views, anchor points 445 are shown on the underside of the floatable and/or inflatable platform 440, for example positioned approximately 20 cm in board (on the underside). These anchor points 445 are designed so that the structure can be anchored and would not need another structure to be attached to. For example, in some applications, the floatable and/or inflatable platform 440 may be anchored in a lake, or shallow part of a sea, etc. at waist height, to allow people to access the boards for use. In these views, ballast bags with dump 435 are also shown. As indicated previously, in some examples further anchor points may be added around the inflatable structure.

In some examples, pairs of horizontal inflated tubes (e.g. retainers or air toggle board rack tubes) with spaced inflatable uprights 410 may be inserted into each side of a floatable and/or inflatable platform 440 platform using the aforementioned air toggle connection system. The uprights 410 offered by the pair of base tubes 145, when positioned directly opposite each other, ensures that the sports water boards can be stored vertically in between the inflatable uprights 410.

In some examples, it is envisaged that the base tube of the inflatable tube 145 may vary in length to fit different size platforms and rack designs. In other examples, different lengths for different racks may be provided.

A first view 400 illustrates a single inflatable retainer or air toggle board rack tube(s) 420 that can be coupled with another inflatable retainer or air toggle board rack tube(s) via an inflatable or floatable platform without water sports boards is illustrated, according to example embodiments of the present invention.

In some examples, an inflatable support tube traversing between the two inflatable tubes 420 at the very end, may be incorporated into the design so that the tubes result in a substantially 'U' shape. One purpose for this exemplary feature is so that it keeps the tubes 420 in an upright position with less chance of the tubes 420 moving about. In some examples, an additional protective layer may be included on the inflatable tube base in the gaps and/or either side of the gaps on the paired inflatable uprights, which may ease a sliding in of the boards. In some examples, a material to enable that, such as an extra layer of PVC for extra protection and wear, or a plastic modelled fitting may be used in this regard.

Figure 5A:
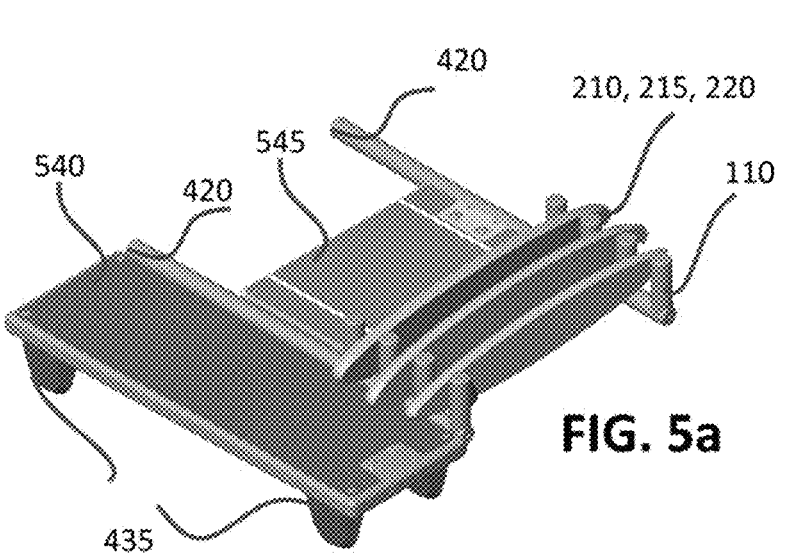
FIG. 5*a*, FIG. 5*b* and FIG. 5*c* illustrate further various views of a second example of two retainers being used with two floatable and/or inflatable platforms, according to the second example embodiments of the present invention.
Figure 5B:
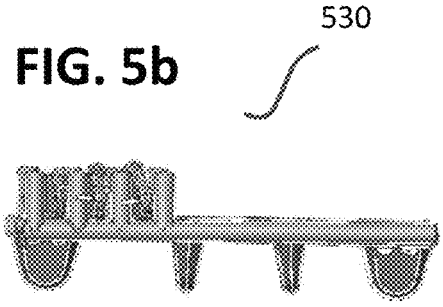
Figure 5C:
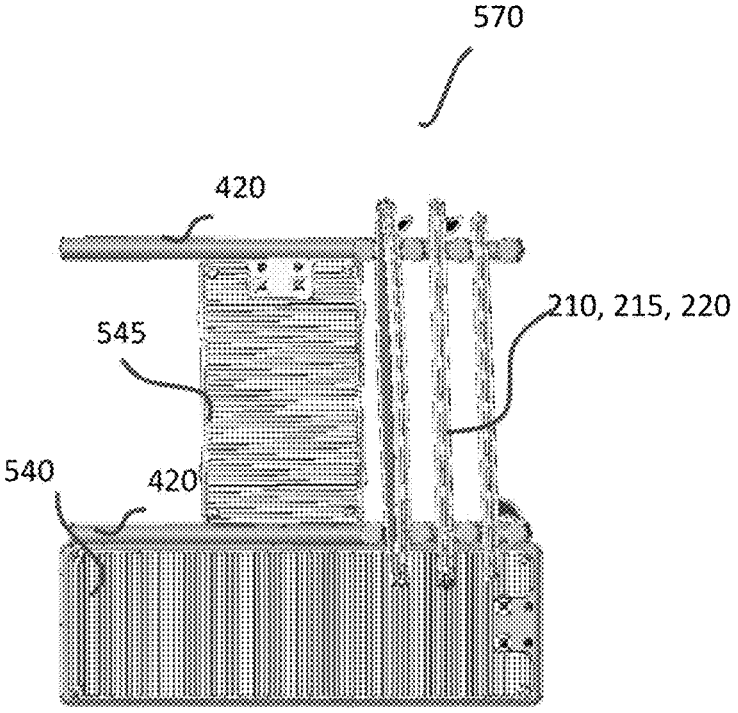

FIG. 5*a*, FIG. 5*b* and FIG. 5*c* illustrate further various views of the second example with two retainers or air toggle board rack tube(s) being used to secure multiple sports water boards with two floatable and/or inflatable platforms, according to the second example embodiments of the present invention. Although this example suggests that the pair of single inflatable retainers or air toggle board rack tube(s) 420 with vertical uprights may be suitable for SUPs, it is envisaged in other examples that the pair of single inflatable retainers or air toggle board rack tube(s) 420 with vertical uprights may accept any variety or size of water sport boards, for example boards 210, 215, 220 of FIG. 2. In some examples, the air toggle board rack tube(s) may be used to also link the platforms together, as shown.

A first pictorial view 500 illustrates a pair of single inflatable retainers or air toggle board rack tube(s) 420 that are attached to two floatable and/or inflatable platforms 540, 545 in a 'T' shape. A second side view 530 illustrates the pair of single inflatable retainers 420 that are attached to the two floatable and/or inflatable platforms 540, 545, each with respective ballast bags 435 (with anchoring points connected to the underside (not shown in this representation). A third top view 570 illustrates the pair of single inflatable retainers or air toggle board rack tubes 420 that are attached to two floatable and/or inflatable platforms 540, 545 in the 'T' shape. Although this example suggests that the pair of single inflatable retainers or air toggle board rack tube(s) 420 with vertical uprights may be suitable for SUPs, it is envisaged in other examples that the pair of single inflatable retainers or air toggle board rack tube(s) 420 with vertical uprights may accept any variety or size of water sport boards, for example boards 210, 215, 220 of FIG. 2.

The views illustrate a construction of two retainers or air toggle board rack tube(s) being used to secure multiple sports water boards, for example, larger stand-up boards 215, surf boards 220; and kite boards or wake boards 210, with two floatable and/or inflatable platforms. This construction allows easy access to the water sports boards stored between the retainers 420 via the floatable and/or inflatable platforms 540, 545. In one example, the width of the floatable and/or inflatable platform 540 is 1.5 m, resulting in a total width of the frame being 1.9 m. In some examples, the size of the platforms may change to accommodate different size boards, for example the length of the platform may be, say, 2.0-2.5 meters and therefore the total width of frame would be 2.5 meters too, wide enough for all boards other than stand-up boards. The length of the platform may be longer to accommodate stand-up boards.

Figure 6:
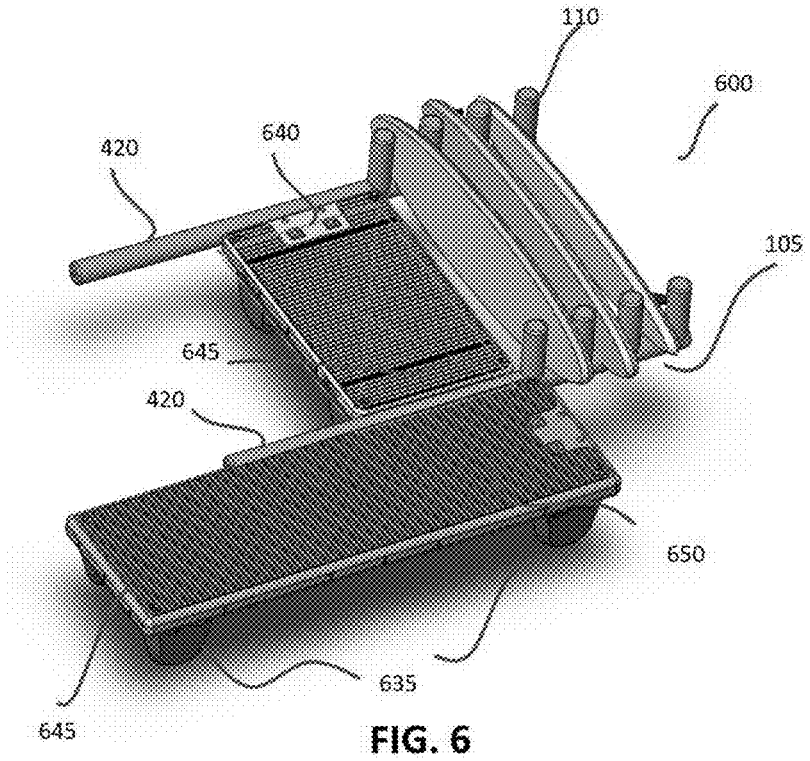
FIG. 6 illustrates a pictorial view of a third example of two retainers being used with two floatable and/or inflatable platforms, according to the second example embodiments of the present invention.

FIG. 6 illustrates a pictorial view 600 of a third example of two retainers or air toggle board rack tube(s) 420 being used with two floatable and/or inflatable platforms 640, 650, according to the second example embodiments of the present invention. Again, a pair of single inflatable retainers or air toggle board rack tube(s) 420 that are attached to two floatable and/or inflatable platforms 640, 650, but in this configuration they are connected in a 'L' shape. Again, the two floatable and/or inflatable platforms 640, 650, are each provided with respective ballast bags with dump 635. Anchoring points are also provided 645 and are designed so that the structure can be anchored and would not need another structure to be attached to. For example, in some applications, the floatable and/or inflatable platform(s) 640, 650 may be anchored in a lake, or shallow part of a sea, etc. at waist height, to allow people to access the boards for use.

Some examples of the invention provide a stable, simple to manoeuvre and easy to install inflatable solo board rack 100, as described in FIGS. 1 to 3. Furthermore, the examples herein described ensure that the inflatable solo board rack 100 is easy to install and/or lift from the water.

Other examples of the invention, as described in FIGS. 4 to 6 provide a number of novel and advantageous features that enhance an inflatable platform, such as the Applicant's NautiBuoy™ Marine Platform, one or more of which can be readily connected to the inflatable platform or to one another.

In some examples, it is envisaged that the components herein before described with respect to inflatable solo board rack 100 may be sold as a kit of parts, e.g. inflatable tube 145, air toggle loops 135, which in some examples may be affixed, e.g. glued, to the inflatable tube 145. Similarly, it is envisaged that floatable and/or inflatable platforms 440, 540, 545, 640, 650, etc. and one or more of the aforementioned features of the floatable and/or inflatable platforms 440, 540, 545, 640, 650, may be sold as a kit of parts. In some examples, it is also envisaged that multiple solo inflatable board racks 100 may be joined together, or joined to one or more inflatable platforms with a deflated air toggle, which may be provided with each platform or available to purchase separately.

Figure 7:
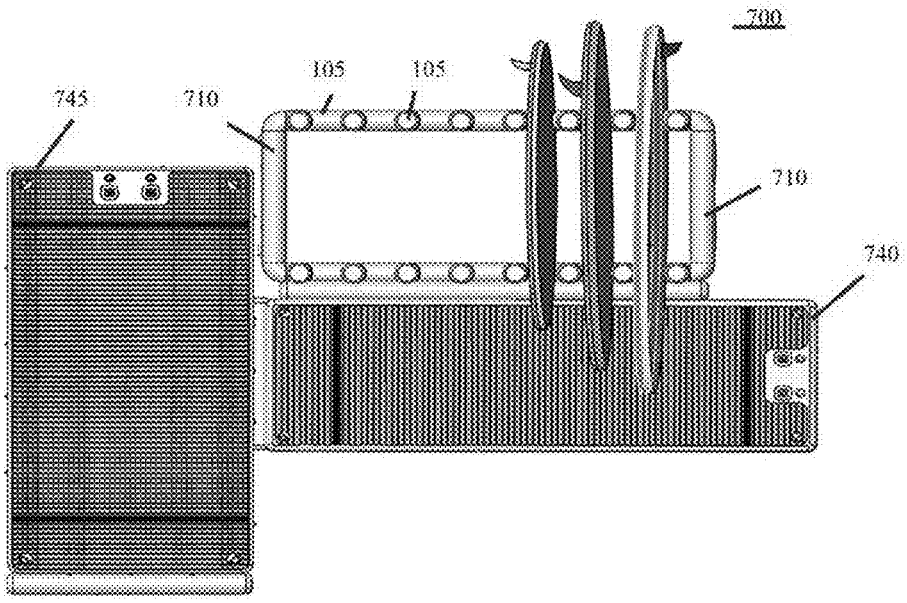
FIG. 7 illustrates a view of a solo board rack with water sports boards stored thereon and connected to a platform, according to some example embodiments of the present invention.

FIG. 7 illustrates a view of a inflatable solo board rack 700 with water sports boards stored thereon and connected to a platform 740, according to some example embodiments of the present invention. In this example, as in the illustrations of FIG. 1, FIG. 2 and FIG. 3, the inflatable solo board rack includes end points 710 to add more stability to the design. The inflatable solo board rack 700 is attached to one of the floatable or inflatable platforms 740, each with respective ballast bags (not shown) that are joined together to form a T-Shape. Anchoring points may also be connected to the underside of the solo board rack and/or floatable and/or inflatable platforms 740, 745 (not shown in this representation). The inflatable solo board rack 700 is attached to the long side of platform 740 using the air toggle linking system. The positioning of the inflatable solo board rack 700 in this way enables the user to stand on the platform and easily lower the boards in between the gaps for storage. It is envisioned in other examples that smaller inflatable solo board racks, for say 4 boards, can also be positioned on the ends of the platform, side on, thereby enabling all 4 boards to still be easily removed for use, and replaced after use. The illustrated configuration enables easy access to all stored boards and gaps for storing a respective board. Again, this example proposes vertical uprights that accept any variety or size of water sport boards, for example boards 210, 215, 220 of FIG. 2.

In some examples, the platforms 440, 540, 545, 640, 650, 740 may include various finish options to this surface design, for example: a) PVC™ layer with Teak foam finish as per known Nautibuoy™ platforms; b) PVC™ layer with a Diamond finish as per Nautibuoy™ Platform; c) PVC™ with multiple surfaces and colours; or d) Polyethylene closed cell foam (also called PE foam), Ethylene-Vinyl Acetate (EVA) or PE/Eva foam in different finishes and/or colours. In some examples, the inflatable tubes for the actual rack may be made from PVC™ or similar materials, such as Hypalon™.

In the forgoing specification, an invention has been described with reference to specific illustrated examples. It will, however, be evident that various modifications and changes may be made therein without departing from the scope of the invention as set forth in the appended claims.

The connections as discussed herein may be any type of mechanical connections. The sizes and locations of particular components need not be exactly as shown, as the drawings and description enable a skilled person to replicate the concepts described herein.

Any arrangement of components to achieve the same functionality is effectively 'associated such that the desired functionality is achieved. Hence, any two components herein combined to achieve a particular functionality can be 'associated with' each other such that the desired functionality is achieved, irrespective of architectures or intermediary components. Likewise, two components so associated can also be viewed as being 'operably connected', or 'operably coupled' to each other to achieve the desired functionality.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term 'comprising' does not exclude the presence of other elements or steps.

Thus, an improved solution is described for securing of water sport boards, particularly for a variety of sized boards and across multiple water sports. The herein described system provides a safe and secure mechanism to secure of water sport boards, advantageously to secure them when not in use in the water, whilst still allowing easy access for use. The inventor of the present invention has recognised and appreciated a number of problems with existing designs, which have been substantially alleviated with the concepts described herein.

The invention claimed is:

1. A floating and inflatable solo water sports board rack comprising:

an inflatable tube having a rectangular shape from a top view, the inflatable tube-comprising multiple paired inflatable vertical free ending uprights with gaps between the vertical free ending uprights configured to receive at least one water sports board there between; and wherein the inflatable tube comprises an inflation valve for inflating the inflatable water sports board rack.

2. The inflatable water sports board rack of claim 1, wherein the gaps between the vertical free ending uprights comprise an additional protective layer located on at least one of: an inflatable tube base between the gaps, either side of the gaps on the paired inflatable vertical free ending uprights.

3. The inflatable water sports board rack of claim 1, further comprising a ballast water-Tillable bag configured to fill automatically when located in a vertically down position.

4. The inflatable water sports board rack of claim 3, wherein the ballast water-fillable bag is located at, at least one of: a plurality of corners of the inflatable water sports board rack; at a mid-point along the inflatable tube, at an ends of the inflatable tube, on an underside of the inflatable tube.

5. The inflatable water sports board rack of claim 1, further comprising weights located in a plurality of corners of the inflatable water sports board rack.

6. The inflatable water sports board rack of claim 1, wherein the inflatable water sports board rack comprises a plurality of individually inflatable connected chambers, each chamber comprising a respective inflation valve and a pressure release valve.

7. The inflatable water sports board rack of claim 1, wherein the multiple paired inflatable vertical free ending uprights are configured to receive there between at least one water sports board from a group of: a stand-up paddle board, a windsurfing board, a kite surfing board, a surf board, a wake board.

8. The inflatable water sports board rack of claim 7, wherein the multiple paired inflatable vertical free ending uprights are configured with a variation of gaps in order to receive at least two different water sports boards.

9. The inflatable water sports board rack of claim 1, wherein the inflatable tube is configured to be coupleable to at least one floatable or at least one inflatable platform.

10. The inflatable water sports board rack of claim 9, wherein the inflatable tube is configured to be coupleable to a floatable or inflatable platform using an air toggle mechanism.

11. The inflatable water sports board rack of claim 10, wherein the air toggle mechanism comprises air toggle loops connected to the floatable or inflatable platform and configured such that, in use, the inflatable tube is deflated and is passed between the air toggle loops and the deflated inflatable tube is then inflated to secure the floatable or inflatable platform to the inflatable tube.

12. The inflatable water sports board rack of claim 1, further comprising a plurality of air-toggle loops configured to receive the inflatable tube when deflated and secure the inflatable tube when inflated.

13. The inflatable water sports board rack of claim 1, wherein the inflatable vertical free ending uprights are provided with a board retainer ring, configured to secure, at least one of: paddles, boards onto the inflatable water sports board rack.

14. The inflatable water sports board rack of claim 1, wherein the inflatable tube also comprises at least one pressure release valve.

15. The inflatable water sports board rack of claim 1, further comprising at least one anchor point configured such that the inflatable water sports board rack is anchorable.

16. A floating and inflatable water sports board rack comprising:

a pair of single inflatable retainers, each including one inflatable base tube comprising in use, multiple paired inflatable vertical free ending uprights with gaps between the vertical free ending uprights;

an additional protective layer on the inflatable base tube to ease a sliding in of the boards;

wherein the pair of single inflatable retainers is configured, when coupled together, to receive between the paired vertical free ending uprights at least one water sports board stored vertically.

17. A floating and inflatable water sports board rack comprising:

a pair of single inflatable retainers, each including one inflatable base tube comprising in use, multiple paired inflatable vertical free ending uprights with gaps between the vertical free ending uprights;

an additional protective layer on the inflatable base tube in the gaps and/or either side of the gaps on the paired inflatable uprights to ease a sliding in of the boards;

wherein the pair of single inflatable retainers is configured to be attached to a floatable or inflatable platform using an air toggle mechanism, wherein the air toggle mechanism comprises air toggle loops connected to the floatable or inflatable platform and configured such that, in use, the inflatable tube is deflated and is passed between the air toggle loops and the deflated inflatable tube is then inflated to secure the floatable or inflatable platform to the inflatable tube.

* * * * *